US005902546A

United States Patent [19]

Kawasetsu et al.

[11] Patent Number: 5,902,546

[45] Date of Patent: May 11, 1999

[54] ALUMINUM ALLOY IMPELLER AND MANUFACTURING METHOD OF THE SAME

[75] Inventors: Nozomu Kawasetsu; Masatomo Shinohara; Kouichiro Imakiire; Masanori Kimura; Keiichi Shiraishi, all of Nagasaki-ken; Masayuki Hayakawa, Aichi-ken; Kazuhisa Shibue, Tokyo; Yoshimasa Okubo, Tokyo; Naoki Tokizane, Tokyo, all of Japan

[73] Assignee: Mitsubishi Heavy Industries, Ltd., Tokyo, Japan

[21] Appl. No.: 08/854,163

[22] Filed: May 9, 1997

[30] Foreign Application Priority Data

Jul. 10, 1996 [JP] Japan ..... 8-180426

[51] Int. Cl.[6] ..... F02B 37/00

[52] U.S. Cl. ..... 420/528; 420/550; 420/552; 148/437; 148/688; 148/689; 148/691; 148/692

[58] Field of Search ..... 420/528, 550, 420/552; 148/437, 688, 689, 691, 692

[56] References Cited

U.S. PATENT DOCUMENTS 4,661,172 4/1987 Skinner et al. ..... 148/12.7

FOREIGN PATENT DOCUMENTS 0 159 511 10/1985 European Pat. Off. .
0 171 798 2/1986 European Pat. Off. .
2 271 424 6/1988 European Pat. Off. .
60-234936 11/1985 Japan .
61-048551 3/1986 Japan .
62-238346 5/1987 Japan .
62-124242 6/1987 Japan .
01 083 630 3/1989 Japan .
01 316 433 12/1989 Japan .

OTHER PUBLICATIONS

European Search Report for EP 97 30 3949 completed Sep. 3, 1997 by G. Ashley.

*Primary Examiner*—Robert Davis
*Assistant Examiner*—M. Alexandra Elve
*Attorney, Agent, or Firm*—Alston & Bird LLP

[57] ABSTRACT

There is disclosed a high heat resistant aluminum alloy impeller, which is suitably used as an impeller, especially for a centrifugal compressor, and for the rotor and the blade of a turbo molecular pump or the scroll of a scroll compressor. Also, a method for manufacturing this aluminum alloy impeller is disclosed. The impeller is composed of an Al—Fe rapid solidification aluminum alloy, which is produced by a spray forming process for spraying a molten metal with inert gas and rapidly solidifying the metal at a cooling speed of $10^{2°}$ C./sec. or higher while simultaneously deposing the metal. The rapid solidification aluminum alloy is subjected to hot extrusion processing within a temperature range of 200° C. to 600° C. and further subjected to hot forging.

14 Claims, 1 Drawing Sheet

ALUMINUM ALLOY IMPELLER AND MANUFACTURING METHOD OF THE SAME

BACKGROUND OF THE INVENTION

1. Field of the Invention

This invention relates to an aluminum alloy impeller and a manufacturing method of the same. For example, the present invention relates to a centrifugal compressor impeller utilized as an engine supercharger or impellers of other types which are suitably used for a high-speed rotation requiring light weight and heat resistance, for instance for a rotor and a blade of a turbo molecular pump or a scroll of a scroll compressor.

2. Description of the Related Art

FIG. 1 is a vertical section view illustrating the structure of a conventional centrifugal compressor impeller.

Referring to FIG. 1, there is shown a conventional centrifugal impeller 1. In the case of an atmosphere suction single stage type product in which a compression ratio is relatively low and a temperature in a highest part (compressed air outlet part) increases only up to about 160°, the impeller 1 is made of a heat resistant aluminum alloy which is produced by normal dissolving/forging. In the case of a high performance product in which a compression ratio is high or a gas temperature in a suction side is high and a temperature in a highest part (compressed air outlet part) exceeds 200° C., the impeller 1 is made of cast steel or a titanium alloy.

Among the conventional compressors described above, an atmosphere suction single stage type centrifugal compressor in which a compression ratio is relatively low (the compression ratio is up to 3.5) has frequently been used as a compressor for a large diesel engine. For this centrifugal compressor, a higher compression ratio has been requested with the attainment of higher performance in an engine side.

In particular, a centrifugal compressor having a compression ratio of 4.0 or higher has been requested. In this case, an air temperature even reaches 200° C. or higher in the exit of the impeller.

Generally, in such an atmosphere suction single stage type centrifugal compressor, a heat resistant aluminum alloy produced by dissolving/forging is selected as a material for the impeller. In order to attain a sufficient heat resistant strength in particular, a JIS A 2618 alloy of "Al—Cu—Mg" which has highest heat resistance at present is often used.

However, a heat resistant aluminum alloy which has been used hitherto is a type for securing a strength typically by executing an age heat treatment (190° C.×about 15 hours). Thus, there was a problem of a reduction in a strength when the alloy was heated for a long time in a temperature region exceeding the above-noted temperature.

Accordingly, it has been difficult to secure a high pressure ratio in the case of the impeller which is made of an aluminum alloy. There is now a tendency to shift to a method for using cast steel or a titanium alloy as a material for an impeller.

However, if an impeller is manufactured by using cast steel or a titanium alloy as a material, since the impeller itself has a very complex form, compared with the impeller made of an aluminum alloy, manufacturing costs are much higher.

Compared with the conventional aluminum alloy, a material density is higher for cast steel or a titanium alloy. Accordingly, the weight of the impeller increases, its responsiveness as a centrifugal compressor deteriorates and imbalance during decentering is larger.

Furthermore, because of a large overhung mass, the stability of a rotor is lost and handling is difficult during disassembling.

In recent years, arts for producing a rapid solidification Al—Fe aluminum alloy or an Al—Fe—Mn aluminum alloy by a rapid solidification process has been disclosed (see Japanese Patent Publication No. 63-9576, Japanese Patent Publication No. 63-10221 and Japanese Patent Provisional Publication No. 62-124242). This process is designed to improve the characteristic of an aluminum alloy by rapidly solidifying the aluminum alloy from its molten state and sintering and solidifying obtained powder (heating and pressuring) so as to produce a fine and uniform structure.

However, with these arts, the ductility of an obtained rapid solidification aluminum alloy is extremely low not only in a room temperature but also even in a high temperature, which makes it impossible to perform hot free forging. Thus, it was impossible to obtain a material which could be suitably used as a reliable member for a large high-speed rotary impeller, and so on, to which a large force was applied.

Among the conventional aluminum alloy producing processes, a powder metallurgy process (referred to as a PM process, hereinafter) for producing rapid solidification powder having a specified composition by a gas atomizing process and obtaining a billet by sintering and solidifying this powder (heating and pressurizing) has mainly been used. However, this process needed many steps such as powder classification, can sealing, degassing and hot extrusion processing and was technically complex, and it was difficult to set many conditions. Accordingly, producing costs inevitably increased.

Furthermore, as a sintered body, its strength, rigidity and other characteristics were improved. However, since its ductility was low not only in a room temperature but also even in a high temperature, secondary processing after sintering was difficult and extrusion processing and free forging of a large billet were practically impossible.

Consequently, the application of the above-noted PM process was limited only to such small members as a piston for a small engine, a connecting rod and a member for an electric apparatus.

SUMMARY OF THE INVENTION

The present invention was made to solve the problems discussed above. It is an object of the invention to provide an easily enlarged impeller made of an aluminum alloy having an excellent high temperature strength characteristic which is stably maintained without any structural changes even when the alloy is heated for a long time if a temperature is set within a range of a room temperature to 400° C. and without any sudden reduction in a strength, instead of an age precipitation type heat resistant aluminum alloy (e.g., JIS A 2618 alloy) produced through the step of dissolving/forging which has conventionally been used or an aluminum alloy produced by the PM process. It is another object of the invention to provide a manufacturing method of such an aluminum alloy impeller.

The object of the present invention is achieved by an aluminum alloy impeller, which comprises an Al—Fe rapid solidification aluminum alloy produced by a spray forming process of spraying a molten metal with inert gas and rapidly solidifying the metal at a cooling speed of $10^{2}$° C./sec. or higher while simultaneously depositing the metal. The rapid solidification aluminum alloy is subjected to hot extrusion processing within a temperature range of 200° C. to 600° C. and also subjected to hot forging within the same temperature range.

In the aluminum alloy impeller constructed in the manner described above, the components of the Al—Fe aluminum alloy include Fe, V, Mo, Zr and Ti. By weight, Fe is 4 to 12%, V is 0.5 to 5%, (Mo+Zr+Ti) is less than 5% and the remaining part is composed of Al and inevitable impurities.

In the aluminum alloy impeller constructed in the manner described above, the components of the Al—Fe aluminum alloy include Fe, Mn, V, Mo, Zr and Ti. By weight, (Fe+Mn) is 5 to 11%, Fe is less than 8%, Mn is less than 8%, V is 0.2 to 4%, (Mo+Zr+Ti) is 0.2 to 4%, a Mn/Fe ratio is between 0.2 and 4 and the remaining part is composed of Al and inevitable impurities.

The aluminum alloy impeller of the invention is an impeller for a centrifugal compressor.

The object of the present invention is also achieved by a method for manufacturing the above-noted aluminum alloy impeller. This method includes the steps of producing an Al—Fe rapid solidification aluminum alloy by a spray forming process of spraying a molten metal with inert gas and rapidly solidifying the metal at a cooling speed of $10^{2°}$ C./sec. or higher while simultaneously depositing the metal, subjecting the obtained rapid solidification aluminum alloy to hot extrusion processing within a temperature range of 200° C. to 600° C., and subjecting the alloy to hot forging.

In the aluminum alloy impeller manufacturing method described above, the alloy is subjected to hot pressing or hot isotropic pressing (referred to as HIP, hereinafter) before or after the hot extrusion processing.

Next, the modes for implementing the present invention will be described in detail.

The aluminum alloy impeller of the present invention is composed of an Al—Fe rapid solidification alloy, which is produced by the spray forming process of spraying a molten metal with inert gas and rapidly solidifying the metal at a cooling speed of $10^{2°}$ C./sec., while simultaneously depositing the metal. The rapid solidification aluminum alloy is subjected to hot extrusion processing within a temperature range of 200° C. to 600° C. and further subjected to hot forging.

Here, in order to obtain the aluminum alloy of the present invention, first, a molding (billet) is obtained by the spray forming process (referred to SF process, hereinafter) for rapidly solidifying an Al—Fe aluminum alloy from its molten state with inert gas at a cooling speed of $10^{2°}$ C./sec. or higher while simultaneously depositing the alloy.

Then, the obtained Al—Fe rapid solidification aluminum alloy powder is subjected to hot extrusion processing within a temperature range of 200° C. to 600° C. If necessary, hot pressing or hot hydrostatic pressing (referred to HIP, hereinafter) may be performed before or after the hot extrusion processing.

In the impeller manufacturing method of the present invention, the SF process which is a rapid solidification process rapidly solidifies an aluminum alloy from its molten state at a cooling speed of $10^{2°}$ C./sec. or higher. Since this SF process sprays a molten metal with inert gas and rapidly solidifies the metal while simultaneously depositing the metal, the number of steps can be greatly reduced compared with the conventional PM process, producing costs can be reduced and a rapid solidification billet can be easily enlarged.

As a billet for the impeller of the present invention, an aluminum alloy which includes Fe, V, Mo, Zr and Ti for its components is used.

By weight, Fe is 4 to 12%, V is 0.5 to 5%, (Mo+Zr+Ti) is less than 5% and the remaining part includes Al and inevitable impurities.

In the impeller manufacturing method of the present invention, an aluminum alloy is rapidly solidified from its molten state at a cooling speed of $10^{2°}$ C./sec. or higher by using the rapid solidification process and thereby a fine and uniform structure is obtained. Such a structure can be formed for the reason that since a metallic structure becomes very fine without any ununiform precipitation after the aluminum alloy is rapidly solidified from its liquid phase at a cooling speed of $10^{2°}$ C./sec. or higher and restrictions on the kinds of alloy elements and the amounts of addition are small, an alloy having a free composition is obtained.

Therefore, in terms of material characteristics, such as a strength and corrosion resistance, the alloy provided by the present invention can be expected to have excellent characteristics which cannot be obtained by a usual ingot metallurgy process (referred to as an I/M process, hereinafter).

According to the present invention, an aluminum alloy impeller having excellent heat resistance and a small material density can be manufactured. If an aluminum alloy impeller is constructed according to the invention, manufacturing costs are reduced more and responsiveness is improved compared with a conventional cast steel or titanium alloy impeller. Thus, the invention is effective in both of an improvement of centrifugal compressor performance and an attainment of low costs.

That is, unlike an age precipitation hardening type heat resistant aluminum alloy (e.g., JIS A 2618 alloy) produced through the step of dissolving/forging which has conventionally been used, an aluminum alloy impeller manufactured according to the present invention has stable characteristics including an excellent high temperature strength characteristic without any structural changes made even when the alloy is heated for a long time if a temperature is set within the range of a room temperature to 400° C. and without any sudden reduction in a strength.

Next, the reason for a limitation of components used in the present invention will be described.

Iron (Fe): A weight ratio is 4 to 12%.

An intermetallic compound is dispersed in pieces when rapid solidification is performed by spray forming. The addition of iron contributes toward the provision of a normal temperature strength and a high temperature strength in a molding material by the dispersing strength of the compound. However, for the alloy of the present invention, too low or too much addition of iron is not preferable. For example, the addition of less than 4% is not effective. If the added amount of iron is too much, its effect is lost. Accordingly, the upper limit of iron addition is 12%. The range of addition should preferably be set to 4 to 12%.

Vanadium (V): A weight ratio is 0.5 to 5%.

Vanadium helps grain refining of the intermetallic compound including Fe and a dispersing strength of Fe, and contributes toward increases in the normal temperature strength and the high temperature strength of the molding material higher than those for an Al—Fe-containing binary alloy. However, for the alloy of the present invention, too low or too much addition of vanadium is not preferable. For a example, the addition of less than 0.5% is not effective. If the added amount of vanadium is too much, its effect is lost. Accordingly, the upper limit of an added amount is 5%. The range of addition should preferably be set to 0.5% to 5%.

The total amount of Mo, Zr and Ti is less than 5%.

The addition of Mo, Zr and Ti further helps the dispersion of the intermetallic compound, and contributes toward increases in the normal temperature strength and the high temperature strength of the molding material higher than those for the Al—Fe-containing binary alloy. However, for the alloy of the present invention, the total addition of 5% or more is not effective. Accordingly, addition should preferably be set to less than 5%.

Next, the case of combining the above-noted components to be added with manganese (Mn) will be described.

The impeller of the present invention is made of an Al—Fe—V aluminum alloy. For its billet, components include Fe, V, Mo, Zr and Ti. By weight, (Fe+Mn) is 5 to 11%, Fe is less than 8%, Mn is less than 8%, V is 0.2 to 4%, (Mn+Zr+Ti) is 0.2 to 4%, Mn/Fe is between 0.2 and 4, and the remaining part is composed of Al and inevitable impurities.

Next, the reason for another limitation of components used in the present invention will be described.

The addition of V and (Mo+Zr+Ti) were already described above. Thus, a reason for the addition of manganese to iron and mixing will be described.

Manganese (Mn) stabilizes a matrix by being solid dissolved in the intermetallic compound, makes it difficult for a processed structure to recover and crystallize again and contributes toward the improvement of the creep strength and the fatigue strength of an alloy. However, since Mn accelerates the deterioration of ductility or tenacity, the addition should preferably be set to less than 8%.

When a content ratio between Mn and F (Mn/Fe) is large, a high temperature strength is improved while ductility or tenacity tends to decline. Accordingly, a ratio of Mn/Fe should preferably be set to be between 0.2 and 4.

In addition, in order to improve a strength, the intermetallic compound dispersed in the alloy matrix should preferably be small. According to the present invention, in order to obtain a desired strength characteristic, it is necessary to control the average grain size of the intermetallic compound to 5 $\mu$m or lower, preferably 3 $\mu$m or lower. By dispersing the intermetallic compound within this range in pieces, a normal temperature strength and a high temperature strength are increased.

(Manufacturing Method of Aluminum Alloy Impeller)

For the aluminum alloy impeller of the present invention, first, an Al—Fe-containing alloy molten metal is rapidly solidified by the spray forming process at a cooling speed of about $10^{2\circ}$ C./sec. or higher and simultaneously deposited, and thereby an Al—Fe-containing aluminum alloy is produced. Then, the alloy is subjected to hot extrusion processing within a temperature range of 200° C. to 600° C. and further subjected to hot forging so as to form a balance between a strength and ductility, and thereby reliability as a rotor is provided.

Herein, the hot extrusion processing is performed in order to subject the Al—Fe-containing rapid solidification aluminum alloy to hot forging and closed die forging.

Comparison in alloy characteristics between an Al—Fe-containing alloy produced by the conventional PM process and an Al—Fe-containing alloy produced by the process of the present invention will be described below with reference to "a testing example".

(1) Material Component

For mixing of an Al—Fe-containing alloy in the present testing example, an "Al-8Fe-2Mo-2V-1Zr" alloy was used as "a material component 1" and an "Al-4Fe-4Mn-2Mo-2V-1Zr" was used as "a material component 2".

(2) Producing Process i) Ingot Production

An ingot having the above-noted specified alloy component was produced by the spray forming process. The size of the ingot was Φ330×1000 mm.

ii) Hot Extrusion Processing

Then, the obtained ingot was heated to about 350 to 450° C. and subjected to hot extrusion processing. If a processing temperature had been lower than 350° C., extrusion processing would have been difficult because of large resistance. If the temperature had been over 450° C., the structure would have been changed after heating for a long time and a reduction would have occurred in a material characteristic.

An extrusion processing ratio is better when it is larger. Preferably, the ratio should be set to at least 2.0 or higher, because when the ratio is less than 2, undesirable cracking may occur during hot forging which is performed thereafter.

In the present testing example, the material was extruded from Φ320 mm to Φ200 mm by setting an extruding temperature to 400° C. and an extruding ratio to 2.56.

iii) Forging

In order to further improve the homogeneity of the material, the material which has been subjected to hot extrusion processing is repeatedly subjected to hot forging (upsetting/cogging) within a temperature range of 350° C. to 450° C. In the present testing example, a forging temperature was set to 400° C.

iv) Then, the material was formed to have a specified shape and by three dimensional machining, an impeller was manufactured.

The material characteristics of the impeller obtained in the testing example are shown in "table 1".

This impeller was compared with the impeller which was manufactured based on the conventional PM process.

The steps of the conventional PM process which was compared will be described below. Since a billet having a large diameter of Φ100 mm or higher cannot be produced by this process, a small billet of Φ30×300 mm was produced.

(1) Material Component

For mixing of an Al—Fe-containing alloy in the comparison example, as in the case of the above-noted testing example, an "Al-8Fe-2Mo-2V-1Zr" alloy was used as "a material component 1" and an "Al-4Fe-4Mn-2Mo-2V-1Zr" alloy was used as "a material component 2".

(2) Producing Process i) Alloy Powder Production

An alloy having a specified component was dissolved, and from this alloy rapid solidification powder was produced by an Ar gas atomizing process. A cooling speed for the gas atomizing process should be set to $10^3$ to $10^{4\circ}$ C./sec.

ii) Hot Extrusion Processing

Then, the obtained alloy powder was classified as one having a grain size of 300 $\mu$m or lower, enclosed in an aluminum canister and degassed in a high temperature vacuum of 400° C. Then, the alloy powder was heated to 450° C. and subjected to hot extrusion processing. An extruding ratio was 9.8 and a billet of Φ18 mm was produced.

The material characteristics of the comparison example are shown in "table 1".

| PRODUCING PROCESS | MATERIAL COMPONENT | ROOM TEMPERATURE TENSILE CHARACTERISTIC | | 250° C. TENSILE CHARACTERISTIC | |
|---|---|---|---|---|---|
| | | TENSILE STRENGTH (kgf/mm$^2$) | ELONGATION (%) | TENSILE STRENGTH (kgf/mm$^2$) | ELONGATION (%) |
| <PROCESS OF THE PRESENT INVENTION> SPRAY FORMING PROCESS + EXTRUSION PROCESSING + FORMING | Al-8Fe-2Mo-2V-1Zr | 44 | 16 | 29 | 25 |
| | Al-4Fe-4Mn-2Mo-2V-1Zr | 47 | 6 | 29 | 19.9 |
| <CONVENTIONAL PROCESS> POWDER MATALLURGY PROCESS + EXTRUSION PROCESSING | Al-8Fe-2Mo-2V-1Z | 46 | 2 | 28 | 6 |
| | Al-4Fe-4Mn-2Mo-2V-1Zr | 44 | 1 | 29 | 4 |

As shown in table 1, from the comparison in material characteristics between the billet produced based on the process of the present invention and the billet produced based on the conventional process (PM process+extrusion processing), it can be understood that although the tensile strengths in a room temperature and a temperature of 250° C. are the same, the elongation for the billet of the present invention during tensile breaking is larger both in the room temperature and the temperature of 250° C.

Therefore, the present invention provides an excellent material as a highly strong and highly tenacious billet. This billet can be used for a product of which high reliability is required, such as a high-speed rotor and the like, or a large product to which a large force is applied.

For the billet produced based on the conventional process (PM process+extrusion processing), since ductility is extremely low not only in the room temperature but also even in the temperature of 250° C., the billet cannot be subjected to hot free forging in this condition.

The aluminum alloy of the present invention is a rapid solidification aluminum alloy produced by a rapid solidification process based on the spray forming process. Accordingly, different from an alloy for securing a strength by a heat treatment, such as a conventional age precipitation hardening alloy, no sudden reduction occurs in the strength of the alloy even in a temperature region which exceeds 200° C. and compared with a currently used A 2618 alloy as a heat resistant aluminum alloy, a high temperature strength characteristic is greatly improved.

For a JIS (Japanese Industrial Standards) A 2000 Al—Cu alloy or an Al—Cu—Mg alloy having heat resistance among the conventional dissolved/forged aluminum alloys, if the alloy is heated at least in a temperature of 180° C. or higher for a long time (100 hours or more) with an age temperature set to 150 to 180° C., its strength is reduced. Accordingly, for a centrifugal compressor with a target total driving period set to 100 thousand hours or more, the conventional heat resistant aluminum alloy can be used only up to a temperature region of about 150° C. However, by using the aluminum alloy of the present invention, heat resistance is improved and the impeller can be driven for a long time even in a temperature region which exceeds 200° C.

Furthermore, according to the Al—Fe—V rapid solidification aluminum alloy of the present invention, hot forging has been established, and an art for molding a large member and simultaneously subjecting the member to hot forging has been realized. Accordingly, compared with the conventional rapid solidification aluminum alloy produced by the PM process, not only a strength but also ductility (elongation of 4% or more during tensile breaking in the room temperature) can be secured and thus the alloy of the invention can be suitably used as a member for a large high-speed rotor.

As a material for a rotor, it was difficult to use the conventional rapid solidification aluminum alloy having a high strength because of low ductility. Further, even high temperature forging was very difficult, cracking occurred because of low ductility, and thus the conventional alloy was not utilized for a large constitutional member.

In other words, the conventional rapid solidification aluminum alloy having a high strength had elongation of 2% or lower during tensile breaking in the room temperature. Thus, this alloy was not utilized for the impeller as a high-speed rotor, because stress generated in the vicinity of the center part by a centrifugal force was largest and there was a possibility of brittle fracture during maneuvering if a material without any ductility was used.

As apparent from the foregoing, for the impeller used for a centrifugal compressor, the present invention provides a rapid solidification aluminum alloy which has stable characteristics including an excellent high temperature strength characteristic without any structural changes even when the alloy is heated for a long time if a temperature is set within the range of a room temperature to 400° C. and without any sudden reduction in the strength.

Therefore, if this alloy is used for, for instance, an impeller made of an aluminum alloy, the impeller can be manufactured to be light in its weight and at low costs. Also, a compression ratio for the manufactured impeller can be increased from the current 3.5 (highest temperature; about 170° C.) to a ratio of 5.0 (highest temperature; about 250° C.). Thus, the impeller can deal with higher performance attained in the engine side.

Consequently, compared with the conventional cast steel or titanium alloy impeller, the impeller of the present invention is advantageous in terms of manufacturing costs and responsiveness. Thus, the invention is effective both in the improvement of centrifugal compressor performance and the reduction of costs.

Furthermore, since hot forging, and so on, are executed, compared with the conventional rapid solidification aluminum alloy, not only a strength but also ductility can be secured (elongation of 4% or more during tensile breaking in the room temperature). Thus, the alloy of the present invention can be suitably used as a member for a large high-speed rotor.

DETAILED DESCRIPTION OF THE PREFERRED EMBODIMENTS

Figure 1:
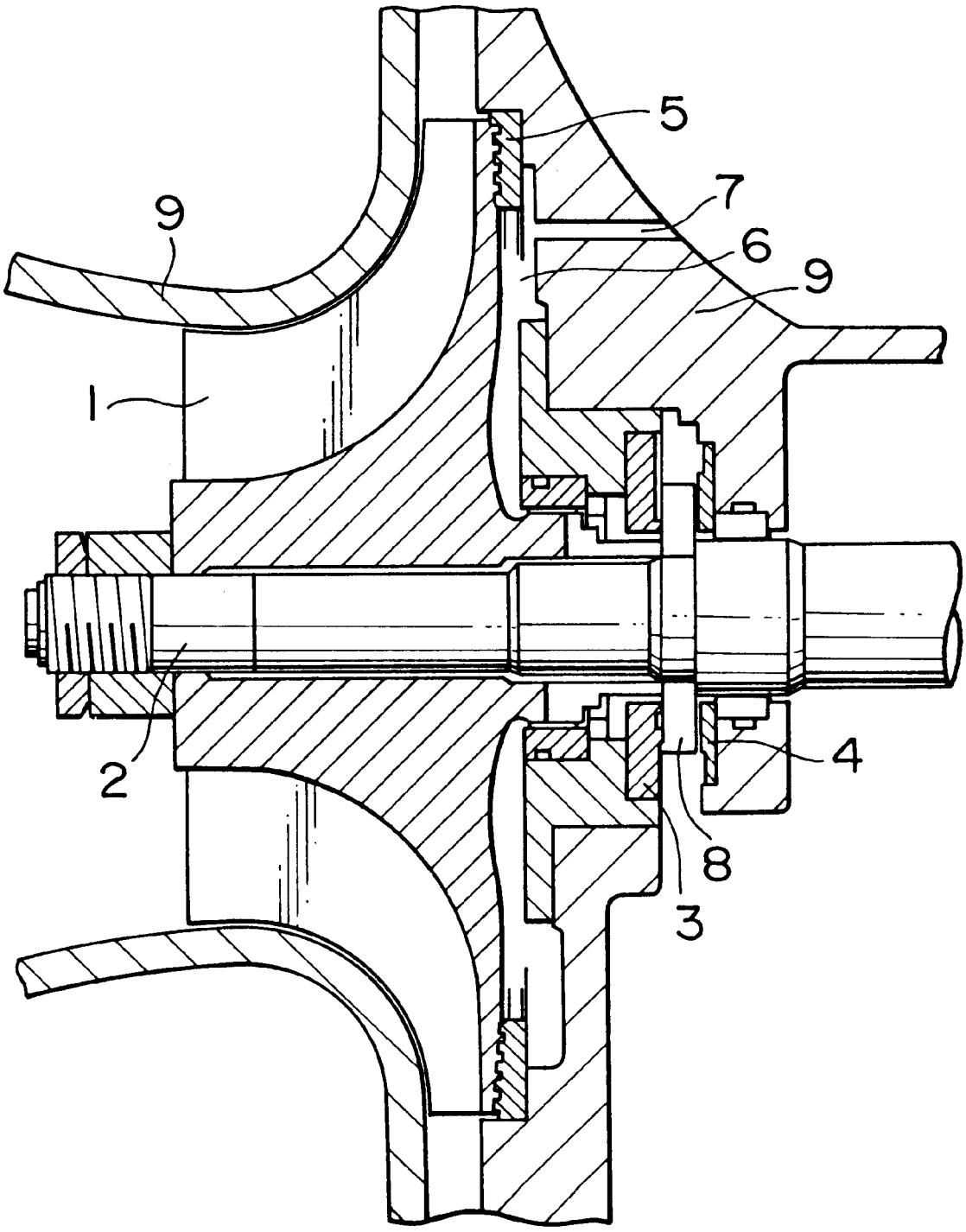
FIG. 1 is a vertical section view illustrating a structure for a conventional centrifugal compressor impeller and an impeller of an embodiment of the present invention.

Now, the embodiments by which the effects of the present invention can be realized will be described.

<Embodiment 1>

FIG. 1 is a vertical section view illustrating a structure of a centrifugal compressor impeller of an embodiment of the present invention.

Referring to FIG. 1, a code 1 represents an impeller, 2 a rotor shaft, 3 a main thrust bearing, 4 an opposite thrust bearing, 5 a labyrinth gasket, 6 a sealing space, 7 a wind hole, 8 a thrust collar and 9 a casing.

The centrifugal compressor of the embodiment is used as an engine supercharger. An air temperature in the impeller exit is high according to the pressure ratio of the centrifugal compressor.

In the embodiment, for instance even when air of a normal temperature is sucked, if a pressure ratio is about 4.0, an air temperature in the impeller exit exceeds 200° C.

For the impeller of the embodiment, the pressure ratio of the centrifugal compressor is set to 4.3 and an air temperature in the impeller exit is set to about 230° C.

The outer diameter of the impeller is approximately Φ350 mm.

A material component is an Al—Fe-containing alloy. A billet was produced by the spray forming process (SF process) for rapidly solidifying the alloy from its molten state with inert gas at a cooling speed of $10^{2}$° C./sec. or higher and simultaneously depositing the alloy.

For mixing of the Al—Fe-containing alloy, one similar to the "Al-8Fe-2Mo-2V-1Zr" as "a material component 1" in the foregoing "testing example" was used.

Thereafter, hot pressing was performed in a temperature of 450° C., hot forging was subsequently performed and thereby a test piece of Φ370×200 mm was produced.

For the obtained billet, a tensile strength in a room temperature was 45 kgf/mm$^2$ and elongation after fracture was 8%. After heating of 250° C.×100 hr., a tensile strength was 28 kgf/mm$^2$ and elongation after fracture was 15%.

By comparing these values with those of the actually machined forging material of the often used JIS A 2618 alloy, it was confirmed that the strength of the alloy of the invention was much greater especially in a high temperature.

For the forging material of the JIS A 2618 alloy, as an example, a tensile strength in a room temperature was 42 kgf/mm$^2$ and elongation after fracture was 12%. After heating of 250° C.×100 hr., a tensile strength was 22 kgf/mm$^2$ and elongation after fracture was 10%.

The test piece after forging was machined to have a final impeller shape, attached to a rotation testing machine on a base and subjected to a rotation testing by a real machine operated up to a specified rotating speed. It was then confirmed that good performance was obtained without any abnormalities such as vibrations.

Therefore, if the impeller made of the rapid solidification aluminum alloy obtained in the above-noted manner is used for a centrifugal compressor, especially in the case of an atmosphere suction single stage type compressor which is often used for a large diesel engine, a pressure ratio can be increased from a current level of about 3.5 (highest temperature; 170° C.) to a level of about 5.0 (highest temperature; 250° C.). Consequently, it is possible to provide a centrifugal compressor, which can satisfy wide ranging requests for an improvement in engine performance, be manufactured at relatively low costs and have good responsiveness.

<Embodiment 2; Addition of Mn to the Aluminum Alloy of Embodiment 1>

The same manufacturing method as that in the <Embodiment 1> was used. For a material component, one similar to the "Al-4Fe-4Mn-2Mo-2V-1Zr" alloy as "a material component 2" in "the testing example" was used.

A hot forged billet (Φ370×200 mm) made of an Al—Fe—Mn—Mo—V—Zr alloy was produced.

For the obtained billet, a tensile strength in a room temperature was 47 kfg/mm$^2$ and elongation after fracture was 7%. After heating of 250° C.×100 hr., a tensile strength was 29 kfg/mm$^2$ and elongation after fracture was 13%.

By comparing these values with those of the actually machined forging material of the often used JIS A 2618 alloy, it was confirmed that the strength of the alloy of the invention was much greater especially in a high temperature.

The test piece obtained after forging was machined to have a last impeller shape, attached to a rotation testing machine on a base and subjected to a rotation testing by a real machine operated up to a specified rotating speed. Then, it was confirmed that there were no abnormalities such as vibrations and good performance was obtained.

<Embodiment 3>

This embodiment is for the rotor and the blade of a high vacuum suction turbo molecular pump.

Conventionally, for the rotor and the blade of the turbo molecular pump, a JIS A 2000 Al—Cu alloy or an Al—Cu—Mg alloy having a high strength and relatively good heat resistance has been used.

However, with the increase of an operation temperature (150° C. to 180° C.) caused by improved suction performance and the extension of a service life, there is a shortage of a creep strength in the currently used material (JIS 2014 alloy).

Accordingly, in the embodiment, a billet was produced by using an Al—Fe-containing rapid solidification alloy and the components and the method similar to those in the <Embodiment 1>. Then, a rotor and a blade were manufactured by machining.

For the obtained billet, it was confirmed that a creep rupture strength of 250° C.×1,000 hr. was the same or higher than the creep rupture strength of 180° C.×1,000 hr. for the conventional material (JIS 2014 alloy) and that a strength was especially greater in a high temperature.

The rotor after final processing was attached to a rotation testing machine on a base and subjected to a rotation testing by a real machine operated to a specified rotating speed. Then, it was confirmed that there were no abnormalities such as vibrations and good performance was obtained.

<Embodiment 4>

This embodiment is for the scroll of a scroll compressor.

In recent years, attention has been paid to a freezing/air conditioning scroll compressor as a high performance compact compressor for business, home or automobile use, mainly because of smaller vibrations and operation sounds. For the main body of such a scroll, in order to attain lighter weight and higher performance, an Al—Si—Cu—Mg aluminum alloy (JIS AC8C.) for forging has been used. This alloy is light in weight and easily produced at low costs.

However, with the improvement of reliability made following a temperature increase (150° C. to 200° C.) in a scroll part caused by improved performance and the extension of a service life, there is a shortage of a high temperature strength (creep strength or fatigue strength) for the currently used aluminum alloy for forging.

Accordingly, in the embodiment, a billet was produced by using an Al—Fe-containing rapid solidification alloy and the components and the method similar to those in the <Embodiment 1>. Then, the billet was processed to have a shape approximately similar to a product by closed die forging and a finished product (scroll) was obtained by performing final machining for the billet. It was confirmed that the high temperature strength (tensile strength, creep rupture strength and high temperature fatigue strength) of the obtained biller was the same as those in the embodiments 1 and 2 and that the strength was much greater compared with that for the aluminum alloy (JIS AC8C.) for forging as a conventional material. Further, it was found that the compressor constituted of the above-noted scroll was capable of performing a high compression operation in which discharge gas temperature exceeded 150° C. and its performance was greatly improved compared with the compressor using the conventional scroll.

As apparent from the foregoing detailed description made with reference to the modes for implementation and the embodiments, according to the present invention, an aluminum alloy impeller having reliability as a rotor and an excellent high temperature strength characteristic can be provided by executing hot forging and closed die forging (hot extrusion processing is also executed when necessary) and keeping balance between a strength and ductility.

Consequently, in the case of an atmosphere suction single stage type often used as a compressor for a large diesel engine, for instance, a pressure ratio can be increased up to about 5.0 (highest temperature; 250° C.) and requests for the improvement of engine performance can be mostly satisfied. This compressor can also be manufactured so as to have good responsiveness as a centrifugal compressor at low costs.

Furthermore, the present invention can be applied for manufacturing of other small engine superchargers, a high speed rotor of which light weight and heat resistance are required, for instance the rotor and the blade of a turbo molecular pump or the scroll of a scroll compressor. The invention is quite effective in the improvement of performance for each of these devices.

We claim:

1. An Al—Fe rapid solidification aluminum alloy, consisting essentially of the composition:

Fe in an amount of from about 4% to about 12% by weight;

V in an amount of from about 0.5% to about 5% by weight;

Mo, Zr and Ti in a combined total amount of less than 5% by weight; and aluminum and impurities.

2. The alloy of claim 1, wherein said alloy is made by a process comprising:

spraying a molten metal comprising said composition with an inert gas by a spray forming process; and rapidly solidifying said metal at a cooling speed of at least $10^{2}$° C./sec while simultaneously depositing said metal.

3. An Al—Fe rapid solidification aluminum alloy, consisting essentially of the composition:

Fe and Mn in a combined total amount of from about 5% to about 11% by weight, Fe being less than about 8%, Mn being less than about 8%, and the Mn/Fe ratio being greater than 0.2 and less than 4;

V in an amount of from about 0.2% to about 4% by weight;

Mo, Zr and Ti in a combined total amount of from about 0.2% to about 4% by weight; and aluminum and impurities.

4. The alloy of claim 3, wherein said alloy is made by a process comprising the steps of:

spraying a molten metal comprising said composition with an inert gas by a spray forming process;

rapidly solidifying said metal at a cooling speed of at least $10^{2}$° C./sec while simultaneously depositing said metal.

5. An article comprising the alloy of claim 1.

6. An article comprising the alloy of claim 3.

7. An impeller made from the alloy of claim 1.

8. An impeller made from the alloy of claim 3.

9. The impeller of claim 7, wherein said impeller is a centrifugal compressor impeller.

10. The impeller of claim 8, wherein said impeller is a centrifugal compressor impeller.

11. An aluminum alloy impeller comprising an Al—Fe rapid solidification aluminum alloy, said alloy consisting essentially of the composition:

Fe in an amount of from about 4% to about 12% by weight;

V in an amount of from about 0.5 to about 5% by weight;

Mo, Zr and Ti in a combined total amount of less than 5% by weight; and aluminum and impurities;

wherein said impeller is made by a process comprising the steps of:

spraying a molten metal comprising said composition with an inert gas by a spray forming process;

rapidly solidifying said metal at a cooling speed of at least $10^{2}$° C./sec while simultaneously depositing said metal to form said rapid solidification aluminum alloy;

extruding the rapid solidification aluminum alloy at a temperature of from about 200° C. to 600° C.; and forging the extruded alloy at said temperature.

12. The impeller of claim 11, wherein said temperature for extruding and forging is from about 350° C. to about 450° C.

13. An aluminum alloy impeller comprising of an Al—Fe rapid solidification aluminum alloy, said alloy consisting essentially of the composition:

Fe and Mn in a combined total amount of from about 5% to about 11% by weight, Fe being less than about 8%, Mn being less than about 8%, and the Mn/Fe ratio being greater than 0.2 and less than 4;

V in an amount of from about 0.2% to about 4% by weight;

Mo, Zr and Ti in a combined total amount of from about 0.2% to about 4% by weight; and aluminum and impurities;

wherein said impeller is made by a process comprising the steps of:

spraying a molten metal comprising said composition with an inert gas by a spray forming process;

rapidly solidifying said metal at a cooling speed of at least $10^{2°}$ C./sec while simultaneously depositing said metal to form said rapid solidification aluminum alloy;

extruding the alloy at a temperature of from about 200° C. to 600° C.; and forging the extruded alloy at said temperature.

14. The impeller of claim 13, wherein said temperature for extruding and forging is from about 350° C. to about 450° C.

* * * * *

UNITED STATES PATENT AND TRADEMARK OFFICE
CERTIFICATE OF CORRECTION

PATENT NO. : 5,902,546

DATED : May 11, 1999

INVENTOR(S) : Kawasetsu et al.

It is certified that error appears in the above-identified patent and that said Letters Patent is hereby corrected as shown below:

On the Title page, item [56], in the References Cited, FOREIGN PATENT DOCUMENTS, line 3, "2 271 424" should read --0 271 424--.

Column 12, line 35, after "0.5" insert --%--.

Signed and Sealed this

Twenty-sixth Day of October, 1999

*Attest:*

Q. TODD DICKINSON

*Attesting Officer*

*Acting Commissioner of Patents and Trademarks*